United States Patent [19]

Courtin

[11] Patent Number: 4,461,285

[45] Date of Patent: Jul. 24, 1984

[54] MANUAL MASSAGER

[76] Inventor: Olivier Courtin, 7, rue Guénégaud, 75006 Paris, France

[21] Appl. No.: 328,677

[22] Filed: Dec. 8, 1981

[30] Foreign Application Priority Data

Dec. 9, 1980 [FR] France ..... 80 26113
Dec. 2, 1981 [FR] France ..... 81 22589

[51] Int. Cl.[3] ..... A61H 7/00
[52] U.S. Cl. ..... 128/62 R; 15/110
[58] Field of Search ..... 128/62 R, 62 A, 63; 15/110, 111, 115, 188, 222

[56] References Cited

U.S. PATENT DOCUMENTS 1,209,516 12/1916 Thompson ..... 15/188
2,218,072 10/1940 Runnels ..... 15/110 X
2,219,436 10/1940 Anderson ..... 128/62 R
2,752,623 7/1956 Tupper ..... 128/62 R X

FOREIGN PATENT DOCUMENTS 2444026 3/1976 Fed. Rep. of Germany .
435635 3/1911 France .
852787 3/1940 France .
59205 5/1954 France .
1104426 11/1955 France .

*Primary Examiner*—John D. Yasko
*Attorney, Agent, or Firm*—Kane, Dalsimer, Kane, Sullivan and Kurucz

[57] ABSTRACT

A manual massager comprises a block (11) for grasping in the hand, said block having a substantially plane surface (19) from which a plurality of blades (21) project. Each blade extends over a major portion of the width of said block, and slopes relative to said substantially plane surface, with all the blades sloping in the same direction. In use, the effect is to provide two different massaging actions, depending on whether the massager is moved along the skin with or against the lie of the blades.

23 Claims, 10 Drawing Figures

MANUAL MASSAGER

The present invention relates to a manual massager.

BACKGROUND OF THE INVENTION

There is a growing demand, particularly from women, for massaging equipment that enables users to massage themselves.

While such a requirement may appear simple to satisfy at first sight, it turns out to be difficult in practice, and none of the presently available equipment is entirely satisfactory.

Massaging is a complex operation which, over the centuries, has been performed by specialists who have devised numerous techniques that achieve the desired effects with varying degrees of success.

A masseur uses all ten fingers of the hands and holds them in various positions relative to the body being massaged. The slope of the fore-arm, the position of the fingers, the parts of the fingers that come into contact with the body are just some of the factors that the masseur can vary while massaging to determine the type of massage being performed.

Some of the massaging equipment currently available is difficult to hold, which makes it clumsy to use and quickly tires the user.

Further, most such equipment is not very effective, and there is even some equipment on the market that is likely to do more harm than good in that it leads to bruising of the skin if the user presses too hard.

Massagers have been tried which use flexible blades, but results have been disappointing, and further the massagers have been difficult to use single-handed.

Preferred massagers in accordance with the present invention are an improvement over those mentioned above. They are also simple to manufacture, and can be used for more than one kind massaging action.

SUMMARY OF THE INVENTION

The present invention provides a manual massager comprising a block for grasping in the hand, said block having a substantially plane surface from which a plurality of blades project, wherein each blade extends over a major portion of the width of said block, and slopes relative to said substantially plane surface, with all the blades sloping in the same direction.

It is the slope of the blades that ensures that the massager is capable of being used for two different massaging actions. When the massager is moved "rearwardly" over the skin, i.e. in a direction that tends to dig the blades into the skin, a Wetterwald type of massaging action is obtained, while moving the massager in the opposite or "forward" direction over the skin gives rise to a more gentle or relaxing action of the light massage or smoothing type.

Further, when used after a bath or a shower, the massager can be used to friction dry the body, with the successive blades scraping away water left behind by the preceding blades.

Preferably the block from which the blades project is in the form of a generally flat oblong of a size and shape that is easy to grasp in the hand, i.e. similar in shape to a clothes brush or to a hair brush of the kind that does not have a handle.

It is advantageous for the projecting edge of the blades to be concave i.e. with a dip towards the middle of the massager, so that they fit better around the generally cylindrical shape of most parts of the body.

Whether the blades are being used for a Wetterwald type of massage or for light massage, the massaging effect obtained depends to some extent on the material from which the blades are made. Now, it is often desirable to be able to obtain a range of effects while performing the same type of massage, in particular to be able to choose between degrees of "toughness".

For this purpose, each blade may have an associated cap removably fixable thereto, said cap being made of a material having different properties than those of the material from which the blade itself is made. In particular the caps may be made of softer material than the blades such that they are capable of greater elastic deformation.

In some cases, it is particularly advantageous for the working edges of the massager, i.e. the skin-contacting parts of the blades and of their caps, should be of differing shapes.

Thus, in particular, the edges of the blades may include a row of rounded teeth, while the edges of the caps are smooth and toothless.

The caps can be removably fixed to the associated blades by any suitable means such as friction, snap action or a fastener.

Each massager may be equipped with several different sets of caps, the sets differing in their capacities for elastic deformation and/or the shapes of the working edges.

Thus, supposing the blades to be harder than the sets of caps, the user can perform a "hard" or "tough" massage using the blades without caps (this is true both for Wetterwald and for relaxation massaging), or a more gentle massage by fitting the caps to the blades. With several sets of caps, the user can vary the degree of massaging effect obtained at will.

BRIEF DESCRIPTION OF THE DRAWINGS

Three embodiments of the invention are described by way of example with reference to the accompanying drawings, in which.

MORE DETAILED DESCRIPTION

Figure 1:
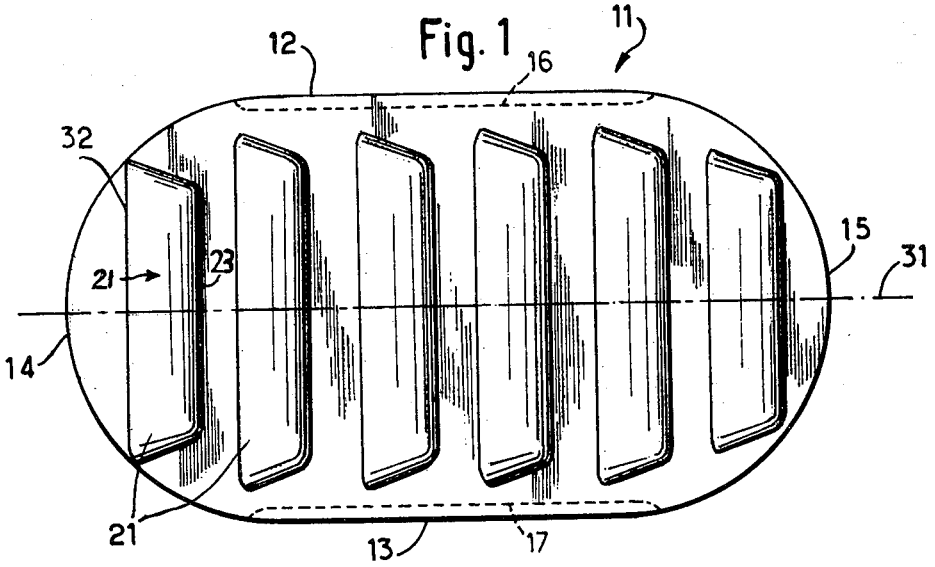
FIG. 1 is a plan view of the underside of a first massager in accordance with the invention.

With reference to FIGS. 1 to 4, a massager comprises a generally flat oblong block 11 for grasping in the hand, with two parallel sides 12 and 13, a rounded "front" end 14 and a rounded "rear" end 15. The sides 12 and 13 are substantially planar, but they advantageously include respective shallow longitudinal grooves 15 and 16 for receiving finger tips on one side and the thumb of the same hand on the other side.

The block 11 has parallel plane upper and lower surfaces 18 and 19 respectively.

Six transversely extending blades 21 project downwardly from the lower surface 19. The blades 21 are parallel to each other and they are evenly distributed along the face 19. The blades 21 taper down from relatively thick root portions 22 where they are attached to the block 11 to relatively thin lower edges or tips 23. In the embodiment shown, the block 11 and the blades 21 are made from a single moulding of plastic material. In any event, the material from which the blades are made is such that the blades deform elastically when pressed too hard against the skin by a user, thereby reducing the pressure on the skin. Each blade may be constituted by a single piece along its entire length or, to improve flexibility, it may be be divided along its length into a few portions, e.g. two or three.

Figure 3:
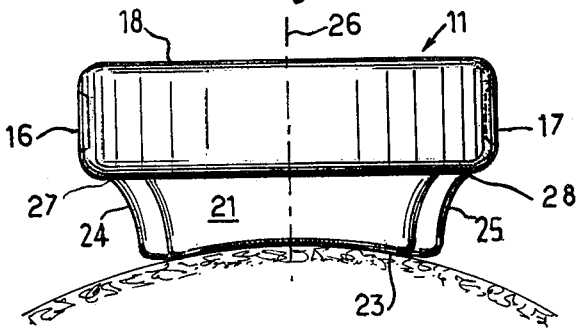
FIG. 3 is a front end view of the massager shown in FIG. 1.

With reference to the end view shown in FIG. 3, it can be seen that the lower edges 23 of the blades 21 are concave in order to fit better around the part of the human body being massaged, and that the outside edges 24 and 25 of the blades are also concave. Further, the edges 24 and 25 slope slightly inwardly towards the central plane of symmetry 26 of the massager from the points 27 and 28 where they are attached to the block 11, such that the outline of each blade 21 is generally trapezoidal, but with three concave sides.

The blades 21 do not project perpendicularly from the lower face 19 of the block 11. Instead they project at an angle such that root 22 of each blade is nearer to the "front" end 14 of the block 11 than is the tip 23 of the blade.

By virtue of this blade slope, the massager can be used in two different modes, thereby exercising two different massaging actions.

In use, the user grasps the block 11 in the hand, e.g. with the thumb on the side 12 and the finger tips on the side 13, for example. The tips 23 of the blades 21 are then brought into contact with the part of the body to be massaged, and the massager is moved lengthwise, either "forwards" or "rearwards".

Figure 2:
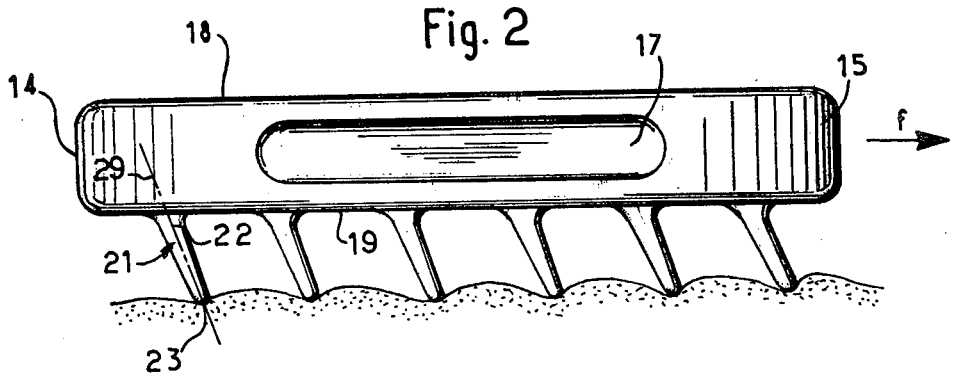
FIG. 2 is a side view of the massager shown in FIG. 1.

In a first mode of use, the massager is moved "rearwardly" in the direction shown by the arrow f in FIG. 2, such that the blades 21 tend to dig into the skin.

The user can thus perform a "fold-and-roll" or Wetterwald type of massage suitable for thinning effect. Depending on how hard the user presses down on the massager, a greater or lesser drainage effect is obtained together with a greater or lesser Wetterwald type "unsticking" effect.

Since the massager has a plurality of blades (six in the embodiment here described), the resulting massage is equivalent to six successful Wetterwald manipulations. The blades are separated from one another by sufficient distance to ensure wave drainage so that six Wetterwald manipulations are effectively performed.

Figure 4:
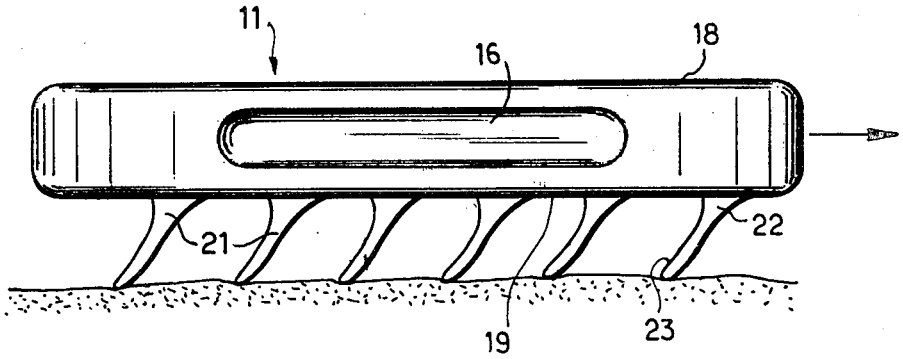
FIG. 4 is a side view similar to FIG. 2, but showing the opposite direction of use.

By using the massager in the opposite, or "forward", direction, as indicated in FIG. 4, a very gentle manipulation can be performed, similar to a masseur's light massage, and suitable for promoting relaxation of the massaged part of the body. This direction of use can also be used to spread a cosmetic evenly over the skin.

The curved shape of the projecting edge 23 of the blades ensures a generally uniform pressure over the convex portions of the human body, which are usually those for which treatment is desired. This helps to avoid exercising too much pressure on some parts, while not applying enough to others.

Furthermore, the blades are used effectively over their entire projecting edge.

Figure 6:
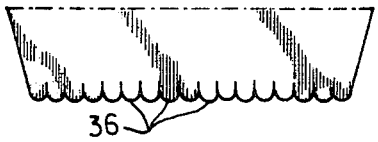
FIG. 6 is an elevation showing a variant blade.
Figure 7:
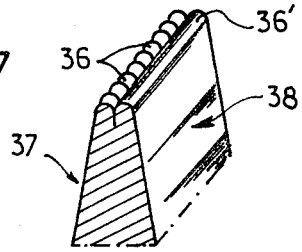
FIG. 7 is a perspective view of part of a blade, with its working edge shown uppermost.

In embodiments shown in FIGS. 6 and 7, the skin-contacting tips 23 of the blades 21 are in the form of a row of rounded teeth 36.

This added roughness is particularly useful in causing dead cells to be eliminated, and in facilitating cell renewal by stressing the skin, but without being too rough.

The teeth may be provided on one or the other, or on both faces of the blades, thereby being active in one or the other, or in both directions of massager uses. In the variant shown in FIG. 7, one face 37 has a row of teeth 36 along its skin-contacting tip, while the other face 38 of the same blade has a smooth tip 36', with a groove in between the two tips on the same blade.

When the teeth are disposed on the edge that is active during Wetterwald type massage, the effect of the massage is increased.

In the embodiment shown in FIG. 1 the blades are attached to the lower surface 19 of the block 11 along straight lines 32 that are perpendicular to its plane of symmetry 31.

Figure 5:
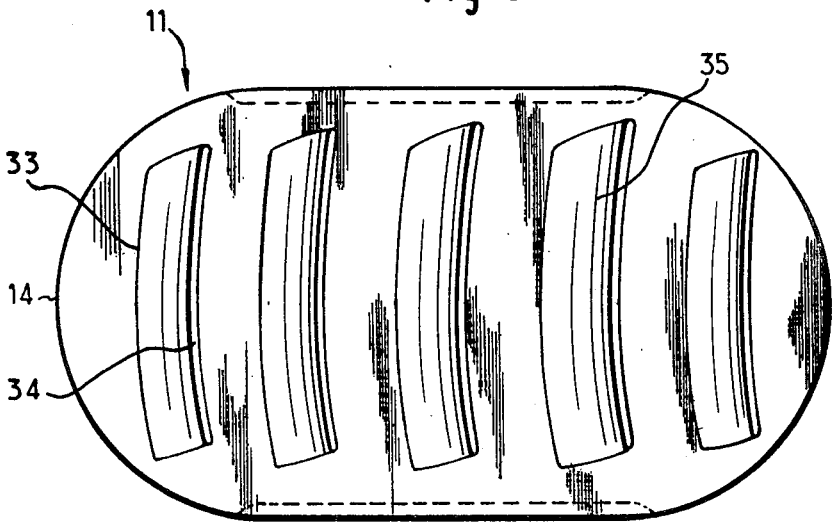
FIG. 5 is a view similar to FIG. 1, but showing a second massager in accordance with the invention.

FIG. 5 shows a variant in which the blades are attached along curved lines 33 such that the convex face of each blade 35 is directed towards the "front" end 14 of the massager. The blades 35 are no longer plane, but have a shape that is substantially a part of a cylinder, rather like blades of a turbine. The skin-contacting tip 34 of each curved blade 35 may be substantially parallel to the curved line 33 along which the blade is attached to the block 11.

Figure 8:
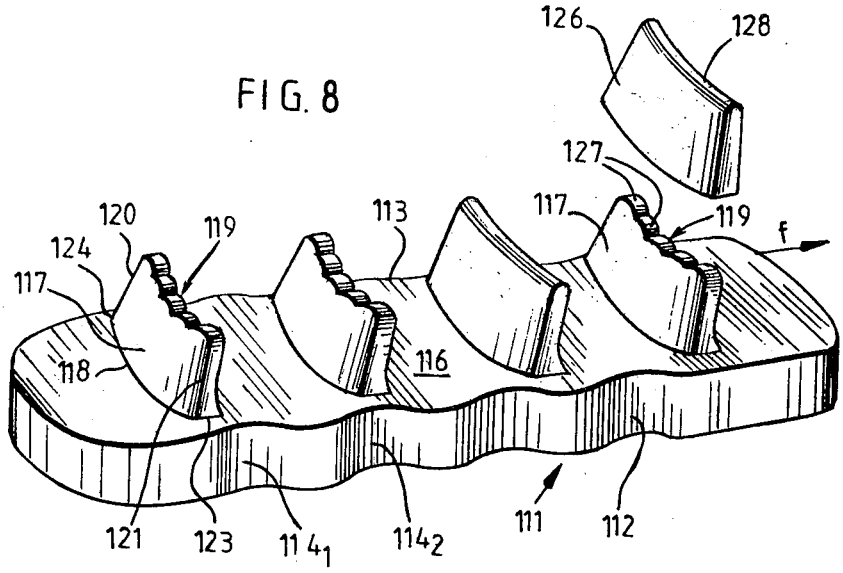
FIG. 8 is a perspective view of a third massager in accordance with the invention, showing how caps may be fitted to the blades.
Figure 9:
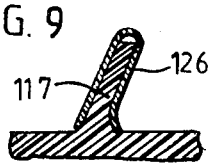
FIG. 9 is a cross section through a blade with a cap fitted thereon.
Figure 10:
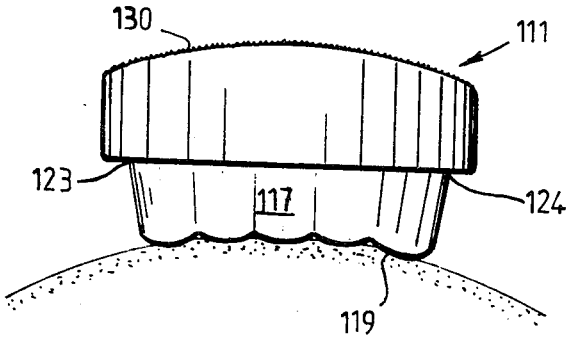
FIG. 10 is a front end view of the massager shown in FIG. 8.

A third embodiment of the massager is shown in FIGS. 8 to 10. Similarly to the preceding embodiments, it comprises a generally flat oblong block 111 for grasping in the hand, but this time the sides 112 and 113 are wavy, having a plurality of shallow transverse grooves $114_1$, $114_2$ etc., to facilitate grasping of the block 111 in the user's hand.

Blades 117 project downwardly from its lower surface 116. They are parallel to one another and project from the lower surface 116 at less than a right angle. As in the other embodiments, the skin-contacting tips 119 of the blades 117 are advantageously concave, as are the outside edges 120 and 121 of the blades, which furthermore slope slightly inwardly towards the central plane of symmetry 122 of the massager from the points 123 and 124 where they are attached to the block 111.

This massager has four blades 117, leaving gaps of about two and a half centimeters between adjacent blades, which is a particularly favourable arrangement for effective action when performing a "fold-and-roll" or Wetterwald type of massage by moving the massager "rearwards" in the direction shown by the arrow f.

Whether the massage is of the Wetterwald or the relaxing type, its effect is naturally dependant on the mechanical characteristics of the material from which the blades are made.

For this purpose, each blade 117 is provided with a removable cap 126. The inside surfaces of the caps 126 match the outside surfaces of the blades 117 so that they fit closely thereon, and are held in place by friction, or by some suitable form of fastener or spring clip action.

The caps 126, when fitted, extend the blades 117 slightly. They are made from material having different mechanical characteristics than the material from which the blades are made. Advantageously they are made of a softer material capable of greater elastic deformation than the blade material.

Advantageously the caps 126 have a different form of skin-contacting tip than that of the un-capped blades. For example, as shown in FIG. 8, the blades 117 have tips 119 comprising a row of rounded teeth 127, while the tips 128 of the caps 126 are smooth and rounded without any discontinuities along the length of the caps.

In this case, the massaging effected with the caps on the blades is gentler than massaging with the caps off.

Several sets of caps may be provided, made of materials having differing mechanical properties and/or differing shapes.

The user can thus choose a set of caps that corresponds most closely to the required massaging effect.

In any of the embodiments described and shown above, the back 18/130 of the block 11/111 may be provided with a rough upper surface (e.g. by moulding), and may advantageously be convex as shown in FIG. 10. The massager then has a second active surface in addition to that provided by the tips of the blades. The user can then grasp the massager with the blades held in the palm of the hand and "polish" the skin with the back of the massager like using a pummice stone, e.g. around the heel or the articulations.

The rough back surface of the massager enables it to serve the purpose of a friction glove or loofah, and it is more hygenic since it can be properly cleaned simply by rinsing out under running water, whereas friction gloves and loofahs are often not cleaned at all, even though they need cleaning, simply because of the time and effort that they require to clean.

An effect similar to that of a friction glove can also be obtained by using the tips of blades that have teeth, while at the same time avoiding the possibility of scratching to which friction gloves are prone. This is because the teeth as described above are rounded and regularly spaced. For this purpose it does not matter which side of the blades the teeth are on, they may be on either side or on both.

When the massager is used after a bath or a shower, it can be used to friction the body while providing a predrying action. The successive blades scrape away the water from the surface of the body, and in this application it is an advantage to use a hydrophobic plastic for the massager.

Finally, the massager described herein has a further advantage over conventional massagers that are in the form of rollers mounted loosely on a rod that is held in both hands. Because the present invention is easy to grasp, one may be held in each hand, thereby enabling a user to massage two surfaces simultaneously, e.g. both sides of a leg, in a manner analogous to that performed by a professional masseur using both hands.

The present massager is particularly attractive to non-professional users because of the numerous different types of massaging and polishing actions that can be performed without any need for further equipment and provide favourable effect on well-being, beauty of the skin and aesthetic of the body.

I claim:

1. A manual massager comprising a grasping block having the general shape of a rectangular parallelepiped, transverse projections having the shape of mutually parallel teeth attached to a face of said block and sloping with regard thereto and of substantially equal length, the distance between two operating zones of neighboring teeth being selected to provide WETTERWALD massaging effect when the massager is moved on the skin of a person in the direction corresponding to the slope of the teeth.

2. A massager according to claim 1, wherein the two transverse faces defining each projection are sloping with regard to the face of the block to which the projection is attached.

3. A massager according to claim 1, wherein the projections have a substantially rectangular outline.

4. A massager according to claim 1, wherein the projections have a substantially trapezoidal outline.

5. A massager according to claim 1, wherein the projecting edges of the projections are curved so as to be concave with a dip towards the middle of the massager.

6. A massager according to claim 1, wherein the outside edges of the projections are curved so as to be concave with a dip towards the middle of the massager.

7. A massager according to claim 1, wherein the projections are of tapering cross section, being thicker at root portions where they join the block than at their projecting edges.

8. A massager according to claim 1, wherein the projections are disposed in substantially parallel planes.

9. A massager according to claim 2, wherein the blades are disposed in a series of curves.

10. A massager according to claim 1, wherein the projections are made of a material such that they are capable of progressive elastic deformation in use.

11. A massager according to claim 1, wherein the skin-contacting projecting edges of the blades are provided with a row of regularly spaced rounded teeth.

12. A massager according to claim 11, wherein the teeth are provided along only one side of said skin-contacting edges, particularly the side that is brought into play when the massager is moved across the skin in such a direction as to tend to increase the angle between the blades and the plane surface from which they project.

13. A massager according to claim 1, wherein the massager has four blades spaced at intervals of about two and a half centimeters.

14. A massager according to claim 1, wherein the block and the blades projecting therefrom are made from a hydrophobic plastic.

15. A massager according to claim 1, wherein each blade has an associated cap removably fixable thereto, said cap being made of a material having different mechanical properties than those of the material from which the blade is made.

16. A massager according to claim 15, wherein the cap is made of a material that is softer and capable of greater elastic deformation than the material of the blade.

17. A massager according to claim 15, wherein the skin-contacting edge of the blade and the skin-contacting edge of the associated cap are of differing shapes.

18. A massager according to claim 16 wherein the skin-contacting edge of each blade has a row of regularly spaced rounded teeth, while the skin-contacting edge of the associated cap is smooth without any discontinuity along its length.

19. A massager according to claim 15, wherein the caps project slightly further from the block than do the blades.

20. A massager according to claim 15, associated with a plurality of sets of caps made of differing materials with differing capacities of elastic deformation.

21. A massager according to claim 15, wherein the caps are held in the associated blades by friction, or by the action of a fastener or a spring clip.

22. A massager according to claim 1, wherein the back of the block for grasping in the hand is provided with a rough surface.

23. A massager according to claim 22, wherein the back of the block is convex.

* * * * *